US007603047B2

(12) United States Patent
Akashi et al.

(10) Patent No.: US 7,603,047 B2
(45) Date of Patent: Oct. 13, 2009

(54) IMAGE FORMING APPARATUS CAPABLE OF FORMING HIGH-QUALITY IMAGE

(75) Inventors: Hironori Akashi, Okazaki (JP); Tetsuya Sakai, Aichi-ken (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 164 days.

(21) Appl. No.: 11/713,667

(22) Filed: Mar. 5, 2007

(65) Prior Publication Data

US 2008/0112718 A1 May 15, 2008

(30) Foreign Application Priority Data

Nov. 13, 2006 (JP) ..... 2006-306823

(51) Int. Cl.
*G03G 15/00* (2006.01)

(52) U.S. Cl. ..... 399/49; 399/302

(58) Field of Classification Search ..... 399/49, 399/162, 302, 303, 308
See application file for complete search history.

(56) References Cited

U.S. PATENT DOCUMENTS

2004/0057739 A1* 3/2004 Shimura ..... 399/49
2004/0253013 A1* 12/2004 Furukawa ..... 399/49
2005/0163519 A1* 7/2005 Takahashi ..... 399/49
2005/0265739 A1* 12/2005 Hamby et al. ..... 399/49

FOREIGN PATENT DOCUMENTS

| | | |
|---|---|---|
| JP | 4-152751 | 5/1992 |
| JP | 5-165295 | 7/1993 |
| JP | 6-236091 | 8/1994 |
| JP | 7-131652 | 5/1995 |
| JP | 8-211669 | 8/1996 |
| JP | 9-9060 | 1/1997 |
| JP | 11-133805 A * | 5/1999 |
| JP | 2001-134754 | 5/2001 |
| JP | 2002-23444 | 1/2002 |
| JP | 2004-54103 | 2/2004 |
| JP | 2004-206137 | 7/2004 |
| JP | 2005-091736 | 4/2005 |

OTHER PUBLICATIONS

Machine translation of JP 11-133805 A dated Oct. 8, 2008.*
Japanese Office Action mailed on Oct. 21, 2008 directed towards counterpart foreign application No. 2006-306823; 5 pages.
Decision to Grant Patent mailed Apr. 7, 2009, directed to counterpart JP-2006-306823; 6 pages.

* cited by examiner

*Primary Examiner*—Sophia S Chen
(74) *Attorney, Agent, or Firm*—Morrison & Foerster LLP

(57) ABSTRACT

A printer detects density of a toner pattern on an intermediate transfer belt, operates a differential value for the detection value, and compares the differential value with a threshold value. If fluctuation of detection values is great and there are detection values of which differential values exceed the threshold value, those detection values are assumed to contain noise due to abnormality of the shape on the belt, and the detection values in such a range are corrected using curve approximation. A tone correction table is updated using the corrected detection values.

12 Claims, 14 Drawing Sheets

IMAGE FORMING APPARATUS CAPABLE OF FORMING HIGH-QUALITY IMAGE

This application is based on Japanese Patent Application No. 2006-306823 filed with the Japan Patent Office on Nov. 13, 2006, the entire content of which is hereby incorporated by reference.

BACKGROUND OF THE INVENTION

1. Field of the Invention

The present invention relates to an image forming apparatus, an image stabilization control method and an image stabilization control program product, and more particularly to an image forming apparatus, an image stabilization control method and an image stabilization control program product correcting tone to obtain desired image density.

2. Description of the Related Art

In an image forming apparatus adapted to electrophotography, as image forming processing is affected by change over time of a developer or a photoconductor, environmental change such as temperature and humidity variation, and the like, it is difficult to maintain image density constant. Accordingly, in the image forming apparatus, in order to obtain desired image density, namely, in order to stabilize the image to be formed, regardless of the state of the developer, the photoconductor and peripherals, image forming conditions such as a development bias potential, a laser exposure amount and the like have been controlled. In addition, in the image forming apparatus, control for correcting the tone is carried out such that input tone matches with output image density. Such control is referred to as image stabilization control.

In controlling tone correction in the image forming apparatus, a detector detects a toner pattern representing a tone correction pattern created on an image carrier, and the density of the toner pattern is determined based on a voltage value representing a result of detection. As a method used to control tone correction, a method of selecting an optimal tone correction table from a plurality of tables used for tone correction (hereinafter, referred to as the tone correction table) stored in the image forming apparatus based on the determined density of the toner pattern has been known. In addition, a method of fitting a selected tone correction table based on the density of the toner pattern has also been known. The tone correction table will be described later.

In addition, a method of calculating a tone correction table directly from determined density of the toner pattern has also been known. As such a method, Japanese Laid-Open Patent Publication No. 2005-091736 (hereinafter, Patent Document 1) discloses a method of calculating a tone correction table by combining linear approximation and curve approximation. In addition, Japanese Laid-Open Patent Publication No. 2004-206137 (hereinafter, Patent Document 2) discloses a method of calculating a tone correction table by performing linear approximation of a detection value greater than a reference value.

The image forming apparatus employing a belt as the image carrier, for example, of a type adapted to a tandem process having an intermediate transfer belt, includes an intermediate transfer belt for primary transfer of a toner image as will be described later. The intermediate transfer belt is an endless belt suspended by a roller at least two portions without loosening, and the belt rotates at a prescribed speed as a result of rotation of the roller.

The portion of the intermediate transfer belt suspended in the longitudinal direction by the roller is bent at an acute angle. Therefore, for example, if the belt is left for a long time without rotating or the like, deformation due to suspension by the roller (hereinafter, such deformation is referred to as creep) is caused at that portion.

The toner pattern transferred to the intermediate transfer belt is detected by a detector that receives a reflected component (reflected light) from a surface of the belt. Therefore, at the creep portion, since a distance between the surface of the belt and the detector, an angle between the surface of the belt and the detector, and the like are varied as a result of deformation of the belt shape, the toner pattern is not appropriately detected.

Such creep is eliminated after the image forming processing is performed and a driven state lasts for some time. Normally, however, image stabilization control is carried out, for example, when the image forming apparatus is turned on after it is left for a long time in a non-driven state or when printing or the like is instructed. Namely, image stabilization control is carried out when it is likely that creep has been caused in the intermediate transfer belt. Accordingly, if the method as disclosed in Patent Documents 1 and 2 is used in image stabilization control to detect the toner pattern transferred onto the intermediate transfer belt in image stabilization control, the result of detection tends to contain noise due to creep. The noise due to creep is more likely when density of the toner pattern is higher or the reflected component from the surface of the belt is less, than when density of the toner pattern is lower or the reflected component is greater. In correcting the tone in image stabilization control, as the toner pattern of high density to the toner pattern of low density are detected, image stabilization control is susceptible to creep. If image stabilization control is carried out using the detection results containing noise, the image forming apparatus cannot form an image of desired image density and a quality of the formed image becomes lower.

In addition to creep, abnormality of the shape on the intermediate transfer belt, for example, breakage such as flaw on the intermediate transfer belt or deformation due to deterioration or the like, may become factors of noise, as in the case of creep. Therefore, the toner pattern is not appropriately detected either in such a case, which leads to lower quality of the formed image.

SUMMARY OF THE INVENTION

The present invention was made in view of the above-described problems. An object of the present invention is to provide an image forming apparatus, an image stabilization control method and an image stabilization control program product, capable of appropriately carrying out image stabilization control and forming a high-quality image when a tone correction pattern containing noise attributed to abnormality of a shape on an image carrier is detected.

In order to achieve the object above, according to one aspect of the present invention, an image forming apparatus includes: a detection unit detecting density of a toner pattern formed on an image carrier; a determination unit determining a detection value containing noise attributed to abnormality of a shape on the image carrier, out of results of detection by the detection unit; a correction unit correcting the detection value containing noise by correcting, using curve approximation, tone corresponding to the detection value containing noise out of the results of detection; and a tone correction unit creating tone correction data based on the results of detection corrected by the correction unit and correcting the tone of an input image.

According to another aspect of the present invention, a method of image stabilization control in an image forming apparatus including an image carrier includes the steps of: detecting density of a toner pattern formed on the image carrier; determining a detection value containing noise attributed to abnormality of a shape on the image carrier out of results of detection obtained in the detecting step; correcting the detection value containing noise by correcting, using curve approximation, tone corresponding to the detection value containing noise out of the results of detection; and creating tone correction data based on the results of detection corrected in the correcting step and correcting the tone of an input image.

According to yet another aspect of the present invention, an image stabilization control program product causes a computer to carry out image stabilization control in an image forming apparatus including an image carrier, including the steps of: detecting density of a toner pattern formed on the image carrier; determining a detection value containing noise attributed to abnormality of a shape on the image carrier out of results of detection obtained in the detecting step; correcting the detection value containing noise by correcting, using curve approximation, tone corresponding to the detection value containing noise out of the results of detection; and creating tone correction data based on the results of detection corrected in the correcting step and correcting the tone of an input image.

With such a configuration, the image forming apparatus according to the present invention has high robustness with respect to a noise component and is capable of forming a high-quality image. In addition, as the time for processing is suppressed, higher-speed image forming processing can be achieved.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
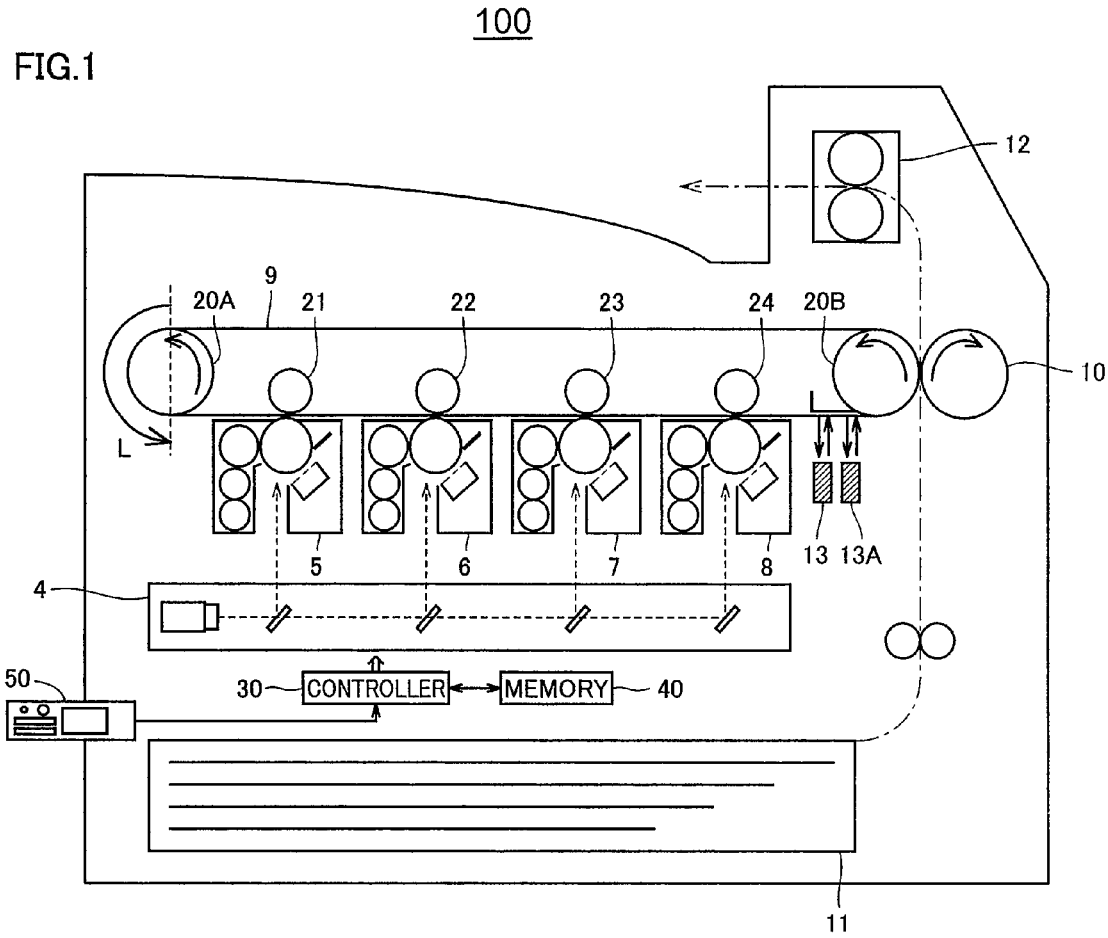
FIG. 1 is a schematic cross-sectional view showing an outline of a hardware configuration of a printer 100.

An embodiment of the present invention will be described hereinafter with reference to the drawings. In the description below, the same elements and components have the same reference characters allotted. Their label and function are also identical.

In the present embodiment, an example in which the image forming apparatus according to the present invention is applied to a tandem-process digital color printer (hereinafter, referred to as printer) will be described. The image forming apparatus according to the present invention, however, is not limited to the printer, and may be applied to a facsimile apparatus or an MFP (Multi Function Peripheral). In addition, the printing process is not limited to a tandem process or a digital process. In addition, the present invention may be applied to a monochrome printer instead of a color printer.

FIG. 1 is a schematic cross-sectional view showing an outline of a hardware configuration of a printer 100 according to the present embodiment, to which the image forming apparatus according to the present invention is applied. Printer 100 forms a color image by successively superimposing toner of four colors of yellow (Y), magenta (M), cyan (C), and black (K).

Referring to FIG. 1, printer 100 includes: an intermediate transfer belt 9 formed as an endless belt suspended by rollers 20A, 20B without loosening and rotating in a direction of an arrow (counterclockwise) in FIG. 1 at a prescribed speed as a result of rotation of rollers 20A, 20B in that direction; imaging units 5, 6, 7, and 8 corresponding to respective color toner of yellow (Y), magenta (M), cyan (C), and black (K) arranged at prescribed intervals along intermediate transfer belt 9; an exposure unit 4 including a printhead performing exposure in accordance with image data and forming an electrostatic latent image in imaging units 5, 6, 7, and 8; a secondary transfer roller 10 paired with roller 20B with intermediate transfer belt 9 being interposed; a paper feed cassette 11 storing paper serving as a printing medium; a fusing unit 12 fusing the toner image transferred onto intermediate transfer belt 9 to the paper; a toner density detector (hereinafter, density sensor) 13 which is an optical detector detecting an amount of adhesion of toner on intermediate transfer belt 9; a controller 30 including a CPU (Central Processing Unit) or the like; a memory 40 storing a program or the like executed in controller 30; and a manipulation panel 50 for input of instruction and manipulation of a user.

Figure 2:
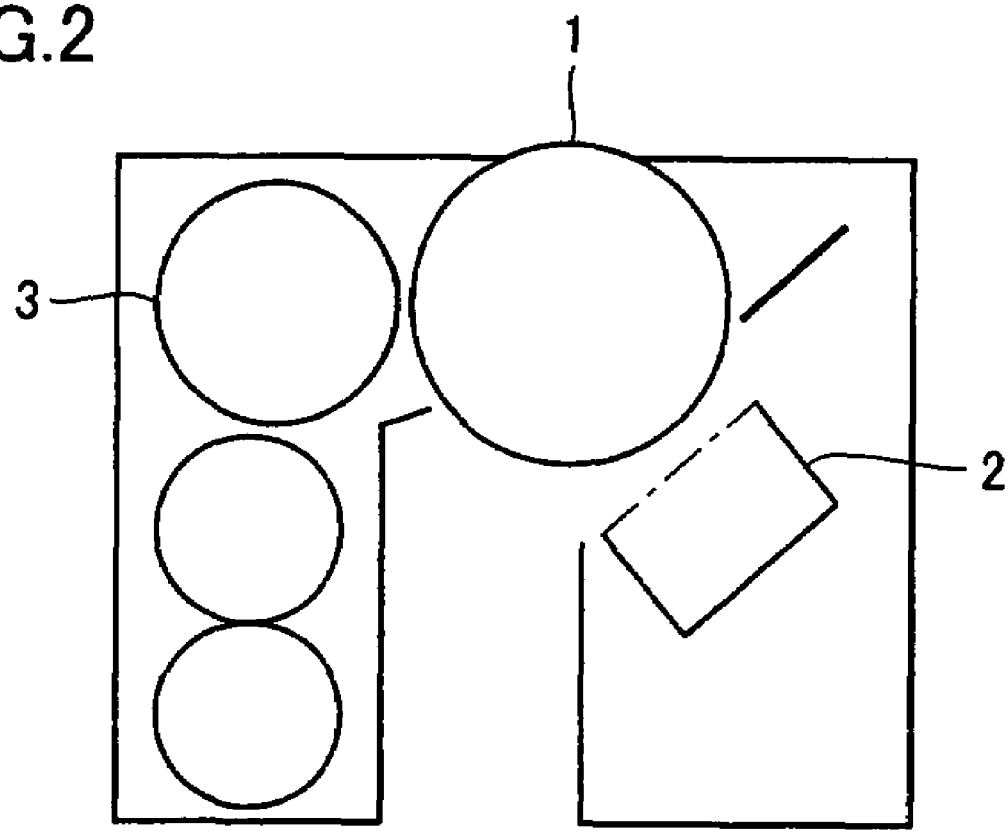
FIG. 2 is an enlarged schematic cross-sectional view of a part of printer 100.

Referring to FIG. 2, each of imaging units 5, 6, 7, and 8 further includes a photoconductor 1, a charger 2 uniformly charging the surface of each photoconductor 1, and a development roller 3 developing the electrostatic latent image formed on the surface of each photoconductor 1 with toner of each color and forming the toner image on the surface of photoconductor 1.

The printhead of exposure unit 4 outputs a laser beam to each photoconductor 1 based on each color data forming the image data, exposes the surface of each photoconductor 1 uniformly charged by charger 2 in accordance with the image data, and forms the electrostatic latent image. A development bias voltage is applied to development roller 3, so that a potential difference from the latent image potential of photoconductor 1 is generated. When charged toner is supplied in such a state, the toner image is formed on the surface of photoconductor 1.

Printer 100 further includes transfer rollers 21, 22, 23, and 24, that are paired with respective photoconductors 1 with intermediate transfer belt 9 being interposed. The toner image formed on the surface of each photoconductor 1 is transferred onto intermediate transfer belt 9 serving as the image carrier, by means of transfer rollers 21, 22, 23, and 24 supplied with a constant voltage or a constant current. This is called primary transfer.

The toner image produced on intermediate transfer belt 9 as a result of primary transfer is in turn transferred to the paper carried from paper feed cassette 11, by means of secondary roller 10. This is called secondary transfer. The toner image produced on the paper as a result of secondary transfer is fused to the paper by fusing unit 12 and output as an electrophotography image.

Manipulation panel 50 inputs an instruction signal in accordance with the instruction and manipulation from the user, such as turn-on or start printing, to controller 30. Controller 30 executes a program read from memory 40 based on the instruction signal, and controls each unit above. In addition, controller 30 may contain time counting means such as a timer, and may execute a program when a prescribed time elapses.

Figure 3:
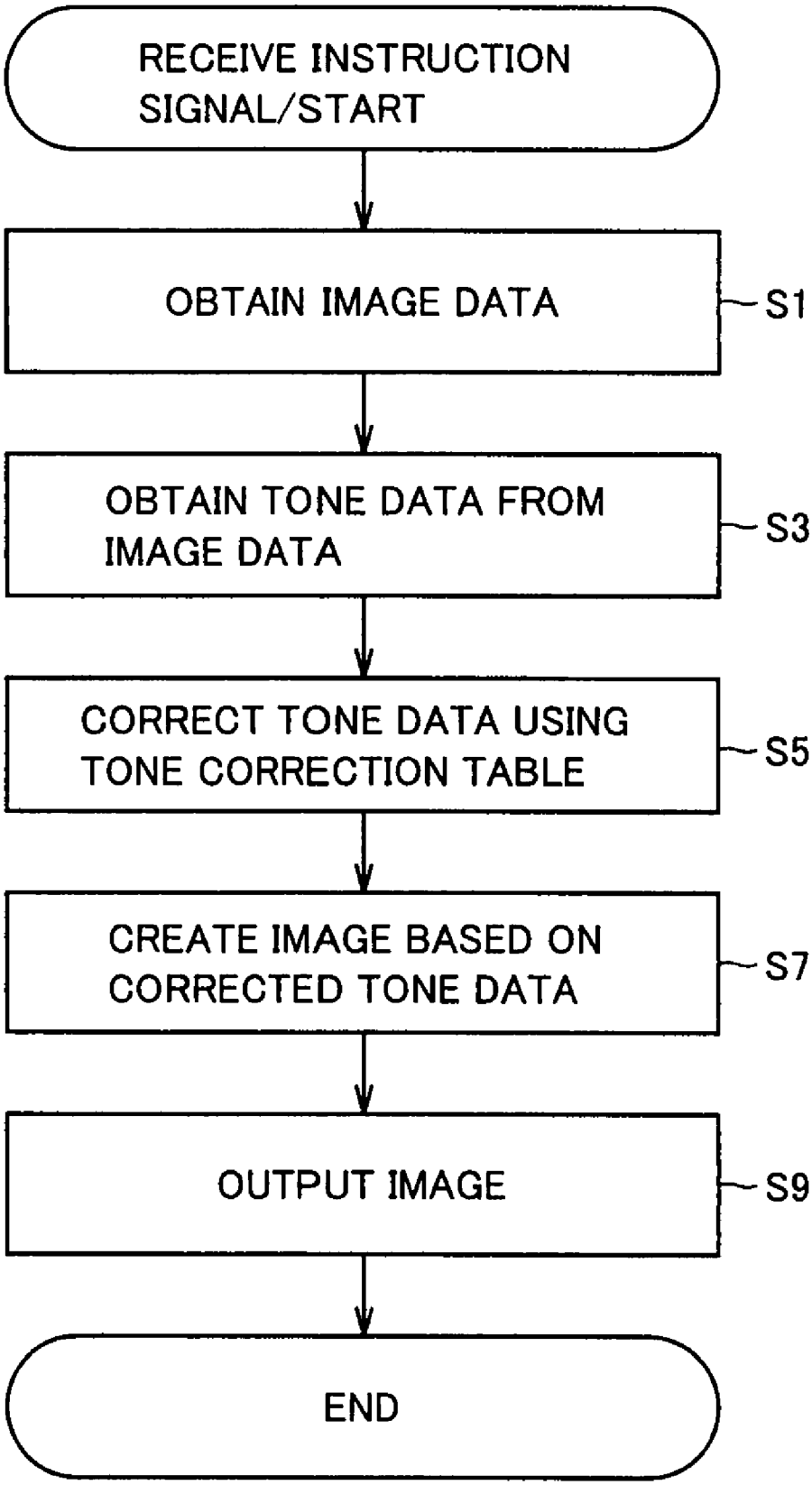
FIG. 3 is a flowchart showing a specific example of processing from input to output of image data, performed in printer 100.

The processing from input to output of the image data shown in the flowchart in FIG. 3 is started by reception of the instruction signal through manipulation panel 50 by controller 30, and performed as a result of execution of the program read from memory 40 and control of each unit shown in FIGS. 1 and 2.

Referring to FIG. 3, initially, printer 100 obtains the image data to be processed, by scanning a document set on a document carrier, reading image data stored in memory 40, or receiving image data from another apparatus if a not-shown communication unit is provided (step S1). Controller 30 obtains tone data from the image data obtained in step S1 (step S3).

The tone data obtained in step S3 is corrected in controller 30 by using the tone correction table stored in memory 40 (step S5), and image creation based on the image data obtained in step S1 is performed, using the corrected tone data (step S7). Then, the image data created in step S7 is output from controller 30 for print on the paper (step S9).

In the present invention, the processing in steps S1 to S9 above is not limited to a particular method and a conventional method may be adopted.

Figure 4:
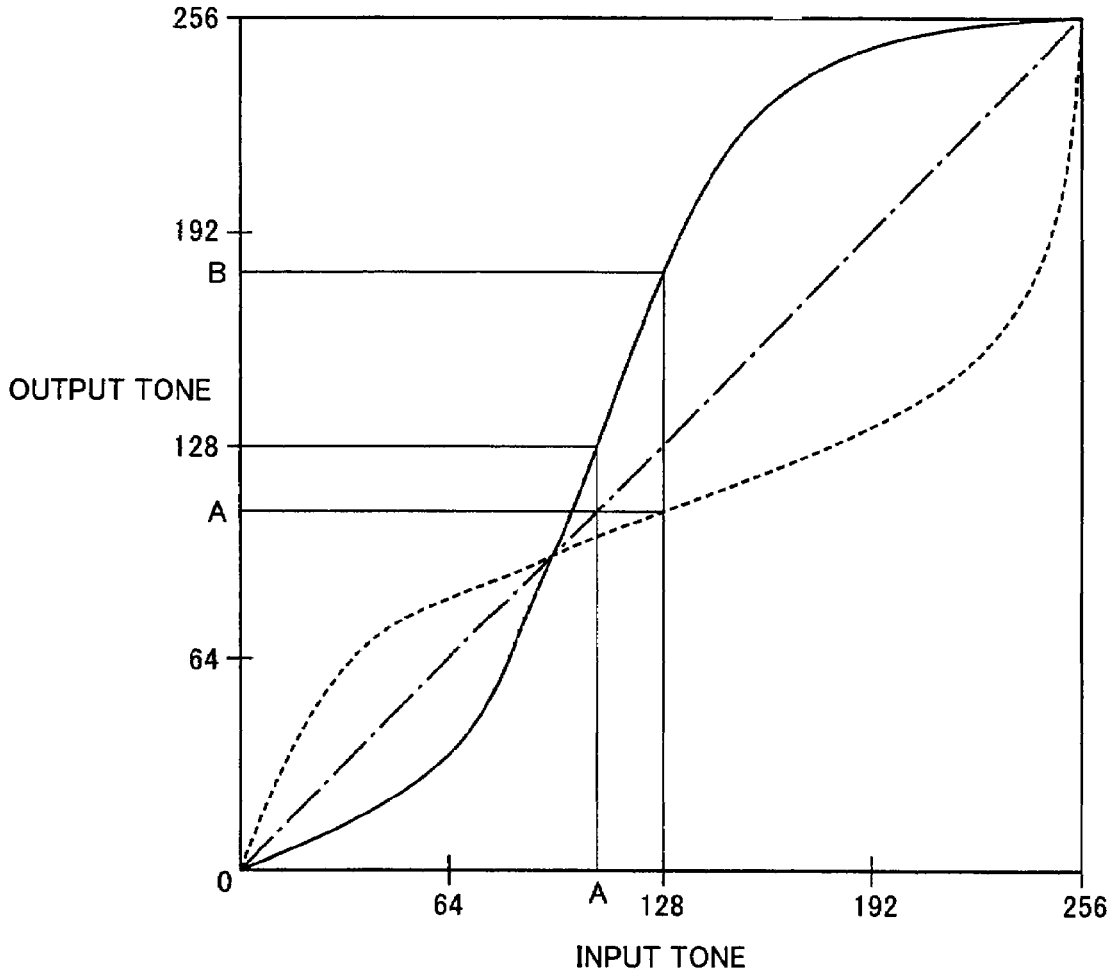
FIG. 4 illustrates a tone correction table.

In the image forming apparatus employing the electrophotography technique, relation of the tone of the output image (hereinafter, abbreviated as the output tone) with respect to the tone of the input image (hereinafter, abbreviated as the input tone) is represented by a curve as shown with a solid line in FIG. 4. The curve in FIG. 4 is obtained by plotting normalized detection values of density of the output image for each tone of the input image, assuming that the output tone represents normalized detection values of density of the output image. As shown with the solid line in FIG. 4, in the image forming apparatus employing the electrophotography technique, variation in the tone of the input image does not match with variation in the tone of the output image.

Such relation between the input tone and the output tone is observed not only in the image forming apparatus employing the electrophotography technique but also in a television receiver and the like, and it is attributed to characteristics of a light-emitting element or the like. Therefore, the curve shown with the solid line in FIG. 4 may be said as a characteristic curve of the image forming apparatus.

If an image is output without correction such that variation in the tone of the output image matches with variation in the tone of the input image, and if the input image is such an image that density continuously varies, in some cases, such variation in density cannot be expressed smoothly in the output image or desired color balance of the input image cannot be obtained in the output image. Therefore, in the image forming apparatus, the input tone should be corrected such that variation in the tone of the input image matches with variation in the tone of the output image. Such control for correction is referred to as gamma correction control.

In printer 100 according to the present embodiment, it is assumed that the input tone is corrected such that the output tone has the same value as the input tone. Namely, the input tone is corrected such that relation of the output tone with the input tone shown with the solid curve in FIG. 4 exhibits the relation shown with a chain-dotted straight line in FIG. 4.

For example, referring to the solid curve in FIG. 4, if the output tone has a value B greater than "128" while the input tone has a value "128", in order to set the output tone to "128", the input tone should have a value A smaller than "128". Printer 100 according to the present embodiment stores in advance correspondence between the input tone and value A above, and corrects the input tone by referring to the correspondence.

The table showing the correspondence is generally referred to as a tone correction table, a gamma correction table, a lookup table, and the like, and it is hereinafter referred to as the tone correction table. In printer 100 according to the present embodiment, the tone correction table is used to correct the input tone such that the output tone has the value the same as the input tone.

As shown with a dotted curve in FIG. 4, the tone correction table is generated by making a curve showing relation between the input tone and the output tone in the image forming apparatus shown with the solid line, axially symmetrical with respect to the straight line (the chain-dotted line in FIG. 4) representing an input and an output having an identical value. By correcting the input tone using the tone correction table shown with the dotted curve in FIG. 4, in the case of the specific example above, the input tone "128" is corrected to value A. When the input tone is corrected to A, referring to the solid curve in FIG. 4, the output tone "128" is obtained, and thus the input tone matches with the output tone.

It is noted that the method of generating the tone correction table described above represents merely one specific example. In the present invention, the method of generating the tone correction table is not limited to such a particular method as the generation method above, and another method may be adopted.

Relation between the input tone and the output tone originates from the characteristics of the apparatus as described above. If the characteristics of the apparatuses are the same, however, the relation is affected by an environment such as a temperature or a humidity, or durability of the apparatus. Therefore, the tone correction table is preferably created or updated at appropriate timing. Here, printer 100 according to the present embodiment performs, in image stabilization control, processing for updating the tone correction table used in step S5 above.

In printer 100, image stabilization control is carried out, for example, at such timing as when the power is turned on, when printing or the like is instructed, or when elapse of a prescribed time since previous drive is detected.

First Embodiment

Figure 5:
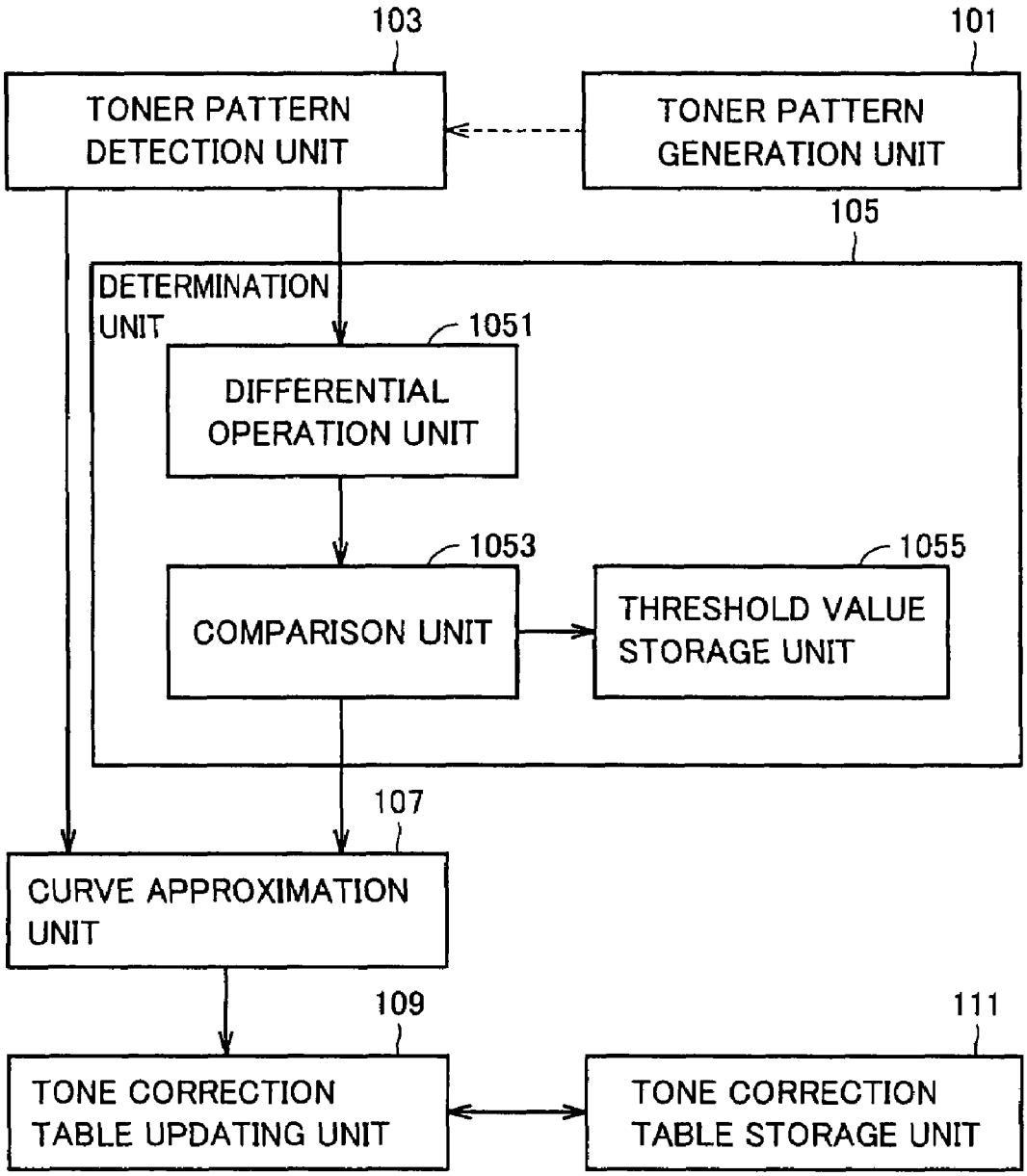
FIG. 5 is a block diagram showing a specific example of a functional configuration for performing processing for updating the tone correction table in image stabilization control in printer 100 according to a first embodiment.

A function for performing the processing for updating the tone correction table in image stabilization control shown in FIG. 5 is attained mainly in controller 30 as a result of operation by controller 30 to read and execute an image stabilization control program stored in memory 40. Alternatively, some of the functions shown in FIG. 5 may be attained by the hardware configuration of printer 100 shown in FIGS. 1 and 2.

Referring to FIG. 5, the functions of printer 100 above are configured to include a toner pattern generation unit 101 generating the toner pattern representing a tone correction pattern on intermediate transfer belt 9, a toner pattern detection unit 103 detecting the toner pattern generated on intermediate transfer belt 9 by toner pattern generation unit 101, a determination unit 105 determining an abnormality region which will be described later based on the detection value, a curve approximation unit 107 subjecting an abnormality region out of the detection values to curve approximation, a tone correction table storage unit 111 storing the tone correction table, and a tone correction table updating unit 109 updating the stored tone correction table based on all detection values of which abnormality region has been approximated.

Figure 6:
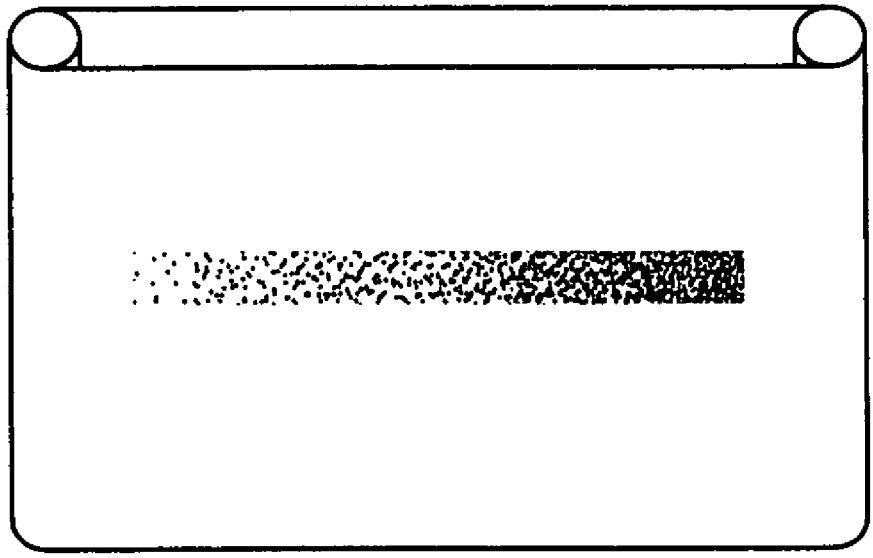
FIGS. 6 and 7 illustrate specific examples of a toner pattern.
Figure 7:
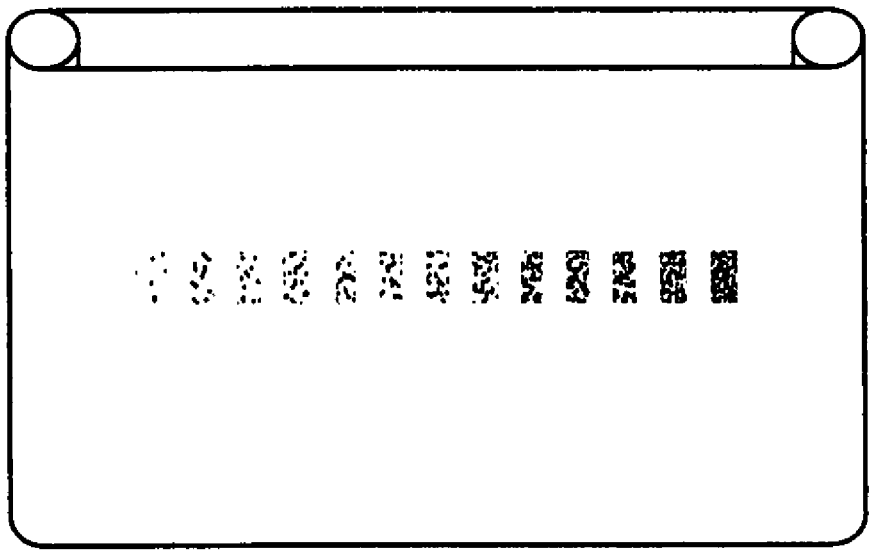

Toner pattern generation unit 101 includes the hardware configuration for secondary transfer of the toner image onto intermediate transfer belt 9, in addition to controller 30. The image data for generating the toner pattern is stored in advance in memory 40, and controller 30 reads the image data from memory 40 in accordance with the image stabilization control program and controls each unit such that secondary transfer of the toner pattern onto intermediate transfer belt 9 is performed based on that image data. In the present invention, the toner pattern generated by toner pattern generation unit 101 is not limited to a particular image, and the toner pattern may be an image having a different area ratio in accordance with the input tone. Specific examples include a single image as shown in FIG. 6, of which area ratio continuously varies in a direction of movement of intermediate transfer belt 9 in accordance with the input tone, and a group of images as shown in FIG. 7, namely, a plurality of successive images having different area ratios in accordance with the input tone in the direction of movement of intermediate transfer belt 9.

Toner pattern detection unit 103 includes density sensor 13 in addition to controller 30. Toner pattern detection unit 103 detects, by means of density sensor 13, density of the toner pattern by detecting reflected light from the toner pattern, and inputs a detection signal to determination unit 105 and curve approximation unit 107.

The portions of intermediate transfer belt 9 suspended by rollers 20A, 20B are bent at an acute angle. Therefore, for example, if the belt is left for a long time without rotating or the like, deformation (hereinafter, such deformation is referred to as creep) is caused at that portion. As described above, abnormality of the shape on intermediate transfer belt 9 such as creep or flaw on the surface of intermediate transfer belt 9 becomes a factor of noise in detection of density of the toner pattern by toner pattern detection unit 103. Namely, the detection value from toner pattern detection unit 103 obtained when such abnormality of the shape on intermediate transfer belt 9 is present is likely to contain noise attributed to the abnormality of the shape. In the description below, noise attributed to creep is mainly considered and a portion containing noise in detection values is referred to as the "abnormality region".

Determination unit 105 is a function attained mainly in controller 30. Determination unit 105 according to the first embodiment further includes a differential operation unit 1051, a comparison unit 1053, and a threshold value storage unit 1055. Differential operation unit 1051 performs a differential operation of the detection value input from toner pattern detection unit 103 and calculates the differential value. Comparison unit 1053 compares the threshold value stored in threshold value storage unit 1055 with the calculated differential value. Determination unit 105 determines as the abnormality region, the region corresponding to the detection value showing the differential value exceeding the threshold value, which is found based on a result of comparison by comparison unit 1053, out of the detection values input from toner pattern detection unit 103. The result of determination is input to curve approximation unit 107.

Curve approximation unit 107 subjects the detection values in a range based on a range determined as the abnormality region by determination unit 105, out of the detection values input from toner pattern detection unit 103, to curve approximation. The detection values input from toner pattern detection unit 103 in the range that has been subjected to curve approximation are input to tone correction table updating unit 109.

Tone correction table storage unit 111 is mainly configured by a memory included in controller 30 or a prescribed area of memory 40. Tone correction table storage unit 111 stores the tone correction table described above. The tone correction table stored in tone correction table storage unit 111 may be stored in advance based on the characteristics of printer 100 or may be updated in immediately preceding image stabilization control.

Tone correction table updating unit 109 is a function attained mainly in controller 30. Tone correction table updating unit 109 obtains relation between the input tone and the output tone as to the toner pattern generated by toner pattern generation unit 101, by converting the detection values input from curve approximation unit 107 to the tone. Then, tone correction table updating unit 109 calculates the tone correction table based on the relation between the input tone and the output tone, and updates the tone correction table stored in tone correction table storage unit 111 to the calculated table. Here, the method of calculating the tone correction table may be a method as described previously with reference to FIG. 4.

In printer 100 according to the present embodiment, tone correction table updating unit 109 updates the tone correction table stored in tone correction table storage unit 111, however, the tone correction table may be created using the method the same as that described previously with reference to FIG. 4 and stored intone correction table storage unit 111.

Figure 8:
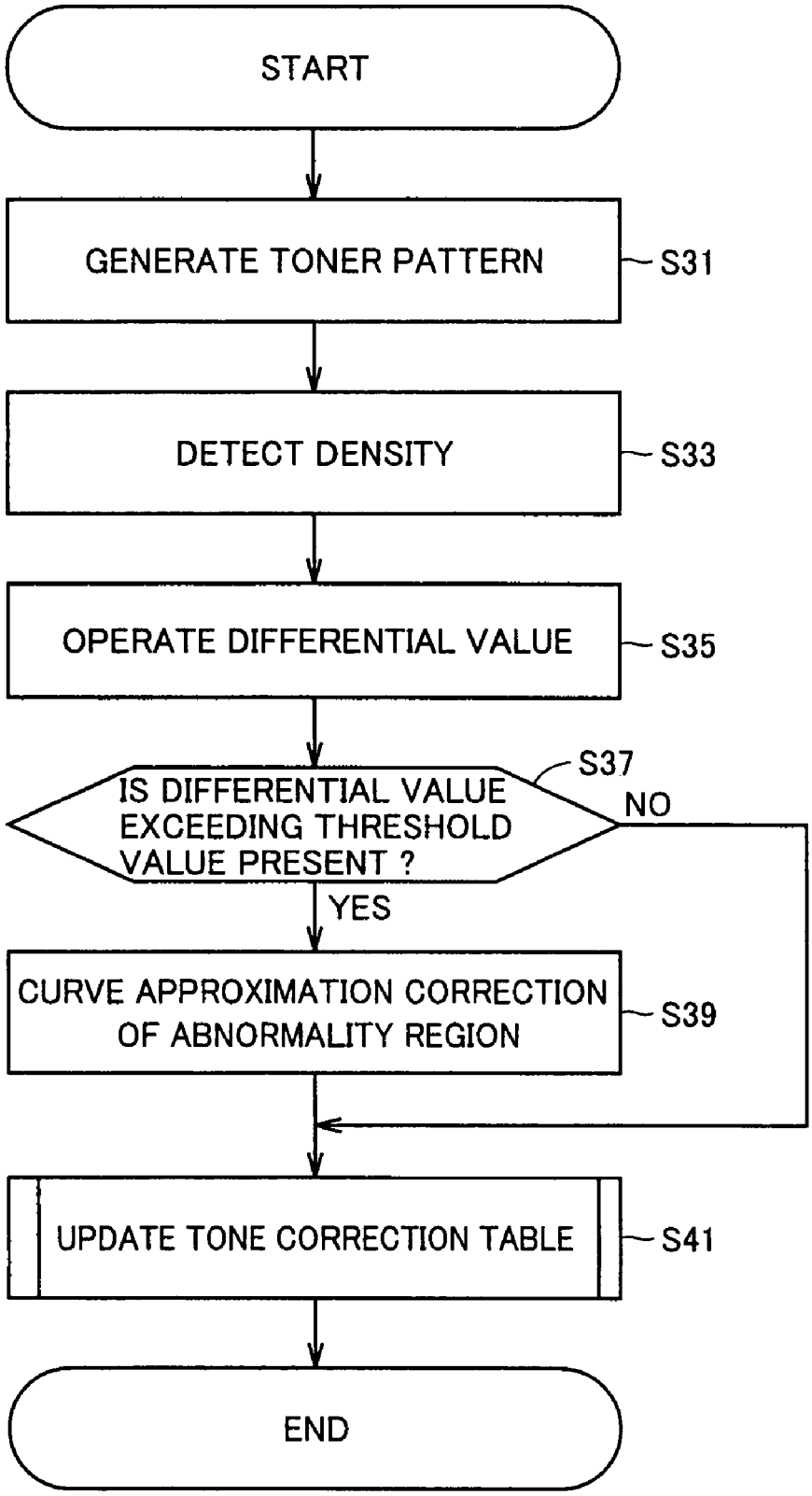
FIG. 8 is a flowchart showing a specific example of processing for updating the tone correction table in image stabilization control in printer 100 according to the first embodiment.

The processing for updating the tone correction table in image stabilization control shown in the flowchart in FIG. 8 is performed as a result of operation of controller 30 to read and execute the image stabilization control program stored in memory 40 and to control each unit shown in FIG. 5.

Referring to FIG. 8, initially, toner pattern generation unit 101 generates the toner pattern on intermediate transfer belt 9 (step S31) and toner pattern detection unit 103 detects density (step S33).

Thereafter, differential operation unit 1051 in determination unit 105 performs the differential operation of all values detected in step S33 (step S35) and comparison unit 1053 determines whether the differential value has exceeded the threshold value or not, whereby the abnormality region is determined (step S37).

Figure 9:
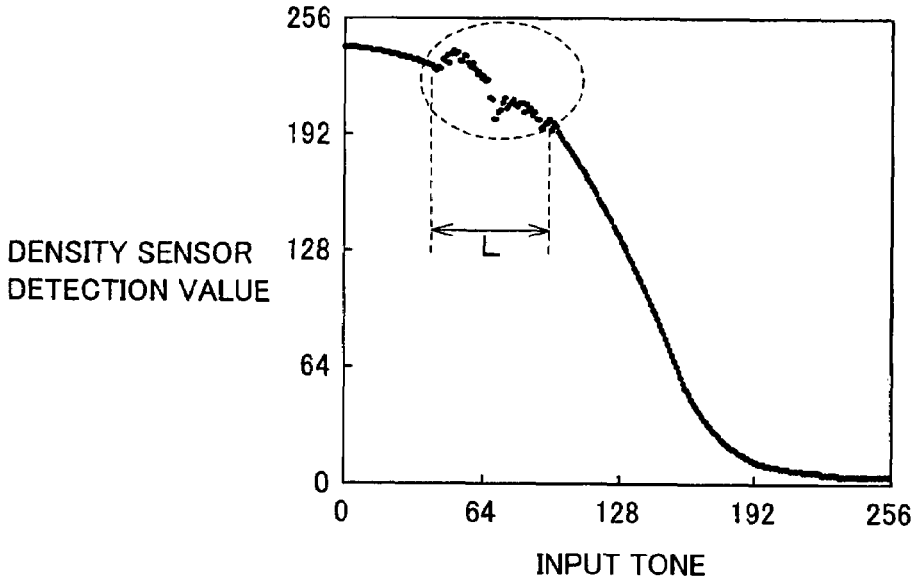
FIG. 9 illustrates a specific example of relation between input tone of a toner pattern and a detection value of density.

Here, it is assumed that the toner pattern in FIG. 6 is generated in step S31 and relation between the detection value of density and the input tone of the toner pattern as shown with the curve in FIG. 9 is obtained based on the values detected in step S33. FIG. 9 shows the curve obtained by plotting the values detected in step S33, for each input tone of the toner pattern.

Figure 10:
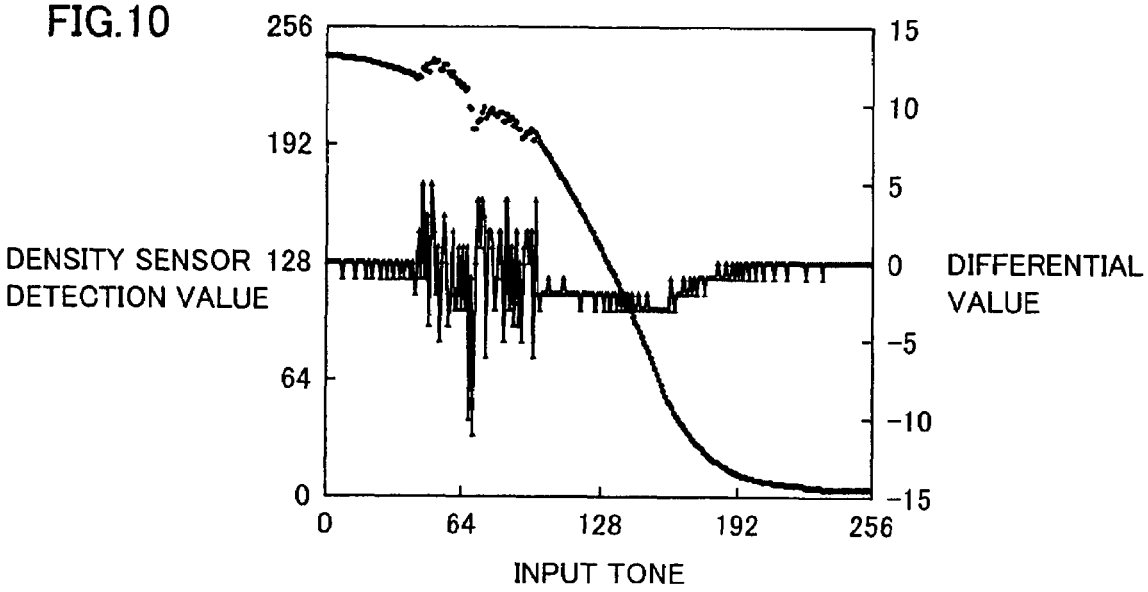
FIG. 10 illustrates a specific example of a differential value of the detection value of density.

FIG. 10 shows the differential values obtained by performing the differential operation for all values in FIG. 9 in step S35. In the specific example shown in FIG. 10, the differential values of a continuous portion in FIG. 9 is within a range of ±3, whereas the differential values of a discontinuous portion in FIG. 9 is at least +4 and at most −4. Accordingly, considering other spike noise and the like as well, the threshold value is preferably set to approximately ±5. Determination unit 105 determines, as the abnormality region, such a portion that the differential value has been determined as exceeding the threshold value by comparison unit 1053 in step S37. Consequently, the encircled section of the curve in FIG. 9 is determined as the abnormality region. If creep is the factor of noise, the range corresponding to half perimeter length L of rollers 20A, 20B is determined as the abnormality region.

If there is a portion determined as the abnormality region, with regard to the relation between the detection value of density and the input tone of the toner pattern (YES in step S37), curve approximation unit 107 subjects the detection values in a range based on the range determined as the abnormality region in step S37 to curve approximation (step S39). If creep is the factor of noise and the range corresponding to half perimeter length L of rollers 20A, 20B is determined as the abnormality region in step S37, in step S39, preferably, the detection values in a range not smaller than the range corresponding to half perimeter length L are subjected to curve approximation, and more specifically, the detection values in a range corresponding to 2L is preferably subjected to curve approximation.

The method of curve approximation in step S39 is not limited to a particular method in the present invention. For example, each constant a1 to a5 in a quartic equation shown as Equation (1) below is found by using least squares method, to obtain a quartic approximation curve in a target range:

$$Y=a1X^4+a2X^3+a3X^2+a4X+a5 \quad \text{Equation (1)}$$

where X represents the input tone and Y represents the detection value.

Among constants a1 to a5 above, the detection value is directly substituted in constant a5 as a boundary condition.

In the specific example above, a quartic curve was used as the approximation curve, however, the order is not limited to the fourth-order.

Figure 11:
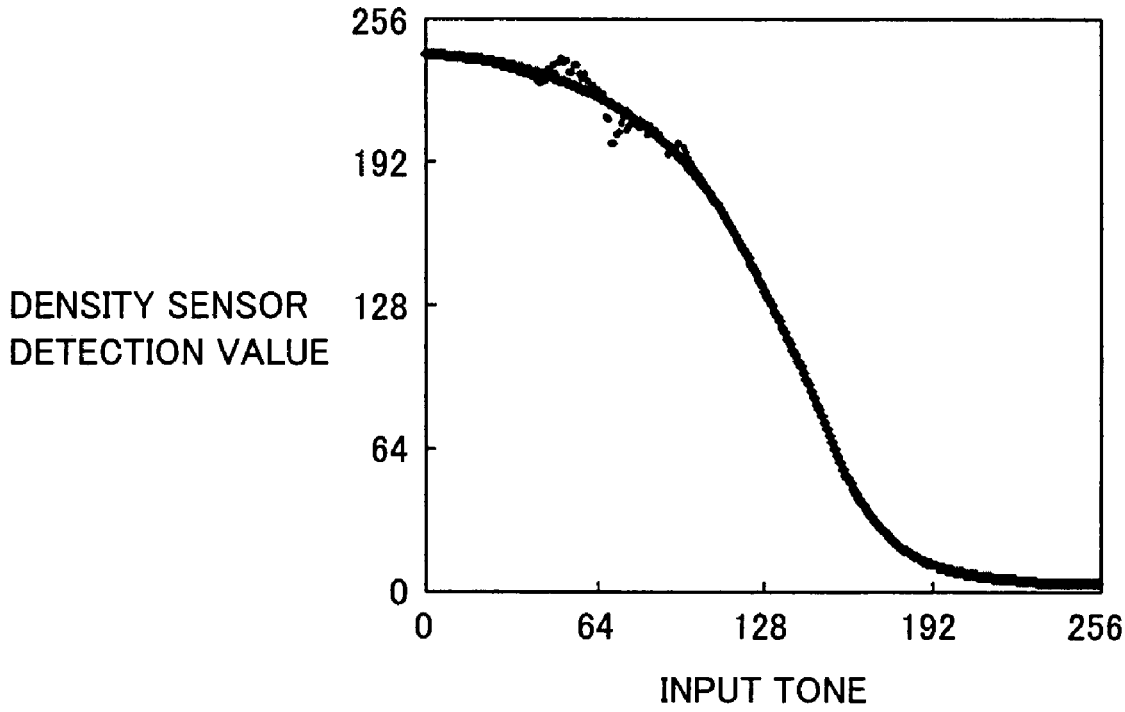
FIG. 11 illustrates a specific example of relation between the input tone of the toner pattern and a corrected detection value of density.

In step S39 above, if the range of the curve corresponding to 2L shown in FIG. 9 is set as the abnormality region and the detection values in that region are subjected to curve approximation, the curve shown in FIG. 9 is corrected as shown in FIG. 11.

Finally, tone correction table updating unit 109 obtains the curve showing the relation between the input tone and the output tone, based on the curve showing the relation between the input tone and the detection value obtained in step S33 or the curve showing the relation between the input tone and the detection value corrected in step S39. Then, tone correction table updating unit 109 uses the curve to update the tone correction table stored in tone correction table storage unit 111 (step S41). In step S41, tone correction table updating unit 109 calculates the tone correction table using the method described previously with reference to FIG. 4, and updates the tone correction table stored in tone correction table storage unit 111.

As a result of execution of such processing for updating the tone correction table in stabilization control in printer 100 according to the present embodiment, even if the detection value obtained by density sensor 13 contains noise due to abnormality of intermediate transfer belt 9 such as creep, the detection value can be corrected and the tone correction table can appropriately be updated. Consequently, robustness with respect to a noise component is enhanced and a high-quality image can be formed in printer 100.

In addition, as described above, out of the detection values obtained by density sensor 13, as the detection values in a range greater than the range containing noise are subjected to curve approximation, the detection values can be corrected with high accuracy.

Moreover, as the detection value can be corrected and the tone correction table can be updated by using single processing for detecting density of a color on intermediate transfer belt 9 by means of the density sensor, higher-speed image stabilization control can be achieved. Consequently, in particular, if image stabilization control is carried out after an instruction to form the image is issued, a time required for a series of image forming processing shown in FIG. 3 from issuance of the instruction until output of the image can be shortened.

Second Embodiment

Figure 12:
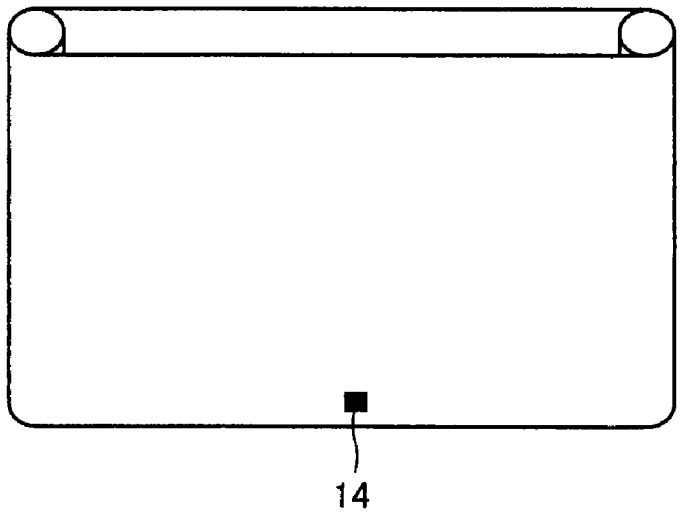
FIG. 12 illustrates a mark 14.

Printer 100 according to the second embodiment further includes a density sensor 13A in addition to the hardware configuration described previously with reference to FIG. 1. In addition, in the second embodiment, as shown in FIG. 12, a mark 14 used for subsequent processing is provided on intermediate transfer belt 9. Mark 14 indicates a reference position on intermediate transfer belt 9, and should only have a color different from the surface of intermediate transfer belt 9 or reflectivity different from intermediate transfer belt 9. In order to avoid erroneous detection in the processing for detecting the toner pattern described previously, as shown in FIG. 12, mark 14 is preferably provided outside an image forming region on intermediate transfer belt 9.

Similar to toner density detector (density sensor) 13 described previously, density sensor 13A detects density of the color of the surface of intermediate transfer belt 9 for example by receiving reflected light from the surface of intermediate transfer belt 9, and inputs the detection signal to controller 30. In the description below, it is assumed that density sensor 13A different from density sensor 13 is provided in printer 100 according to the second embodiment, however, density sensor 13A may be realized by density sensor 13. Namely, the identical density sensor may attain a function of both of density sensor 13 and density sensor 13A which will be described later.

Figure 13:
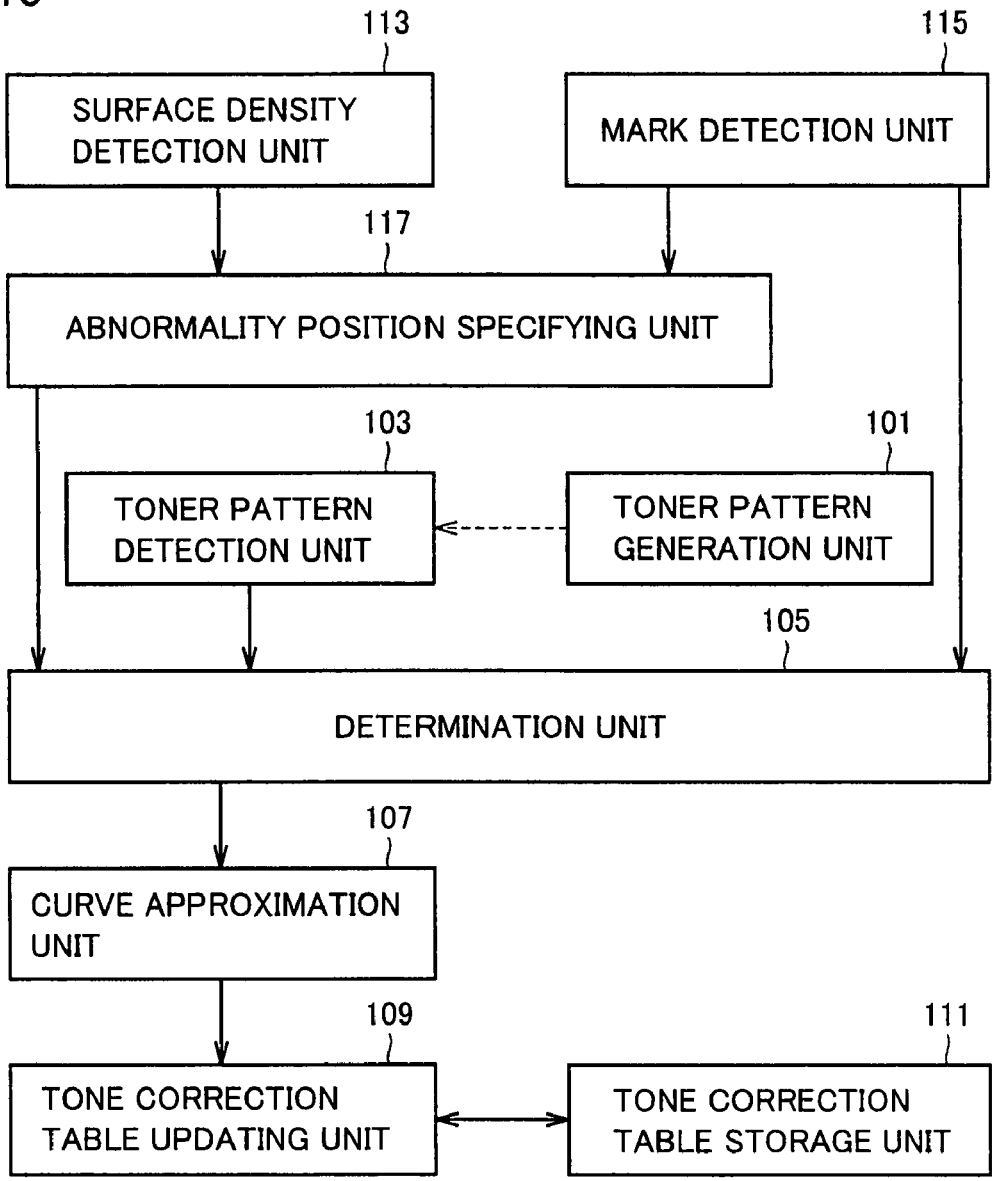
FIG. 13 is a block diagram showing a specific example of a functional configuration for performing processing for updating the tone correction table in image stabilization control in printer 100 according to a second embodiment.

A function for performing the processing for updating the tone correction table in image stabilization control shown in FIG. 13 is also attained mainly in controller 30 as a result of operation by controller 30 to read and execute an image stabilization control program stored in memory 40. Alternatively, some of the functions shown in FIG. 13 may be attained by the hardware configuration of printer 100 shown in FIGS. 1 and 2.

In addition to the functions of printer 100 according to the first embodiment shown in FIG. 5, the function of printer 100 according to the second embodiment is configured by further including a surface density detection unit 113 detecting density of the color of the surface of intermediate transfer belt 9, a mark detection unit 115 detecting mark 14 provided on intermediate transfer belt 9, and an abnormality position specifying unit 117 specifying an abnormality position on intermediate transfer belt 9 which will be described later. In the following, difference from the functions of printer 100 according to the first embodiment shown in FIG. 5 will mainly be described.

Surface density detection unit 113 includes density sensor 13A in addition to controller 30. Surface density detection unit 113 detects density of the color of the surface of intermediate transfer belt 9 for example by detecting reflected light from the surface of intermediate transfer belt 9 by means of density sensor 13A, and inputs the detection signal to abnormality position specifying unit 117.

Mark detection unit 115 also includes density sensor 13A in addition to controller 30. Mark detection unit 115 detects density of the color of the surface of intermediate transfer belt 9 for example by detecting reflected light from the surface of intermediate transfer belt 9 by means of density sensor 13A, and specifies the reference position shown with mark 14. Position information indicating the reference position is input to abnormality position specifying unit 117 and determination unit 105.

Abnormality position specifying unit 117 is a function attained mainly in controller 30. Abnormality position specifying unit 117 specifies a position at which abnormality on intermediate transfer belt 9 such as creep or flaw causing noise is present or a position that could serve to specify a range where abnormality is present (for example, a start position and an end position of that range), based on the detection signal input from surface density detection unit 113, the position information input from mark detection unit 115, and a moving speed of intermediate transfer belt 9 stored in advance. This position is hereinafter referred to as the abnormality position. The specified abnormality position is input to determination unit 105.

Determination unit 105 according to the second embodiment specifies the position on intermediate transfer belt 9 where the toner pattern is generated, based on the reference position input from mark detection unit 115, and determines whether the toner pattern has been formed at the position where the abnormality is present or in a manner overlapped with the range where the abnormality is present, based on the position of the toner pattern and the abnormality position input from abnormality position specifying unit 117. The result of determination is input to curve approximation unit 107.

Figure 14:
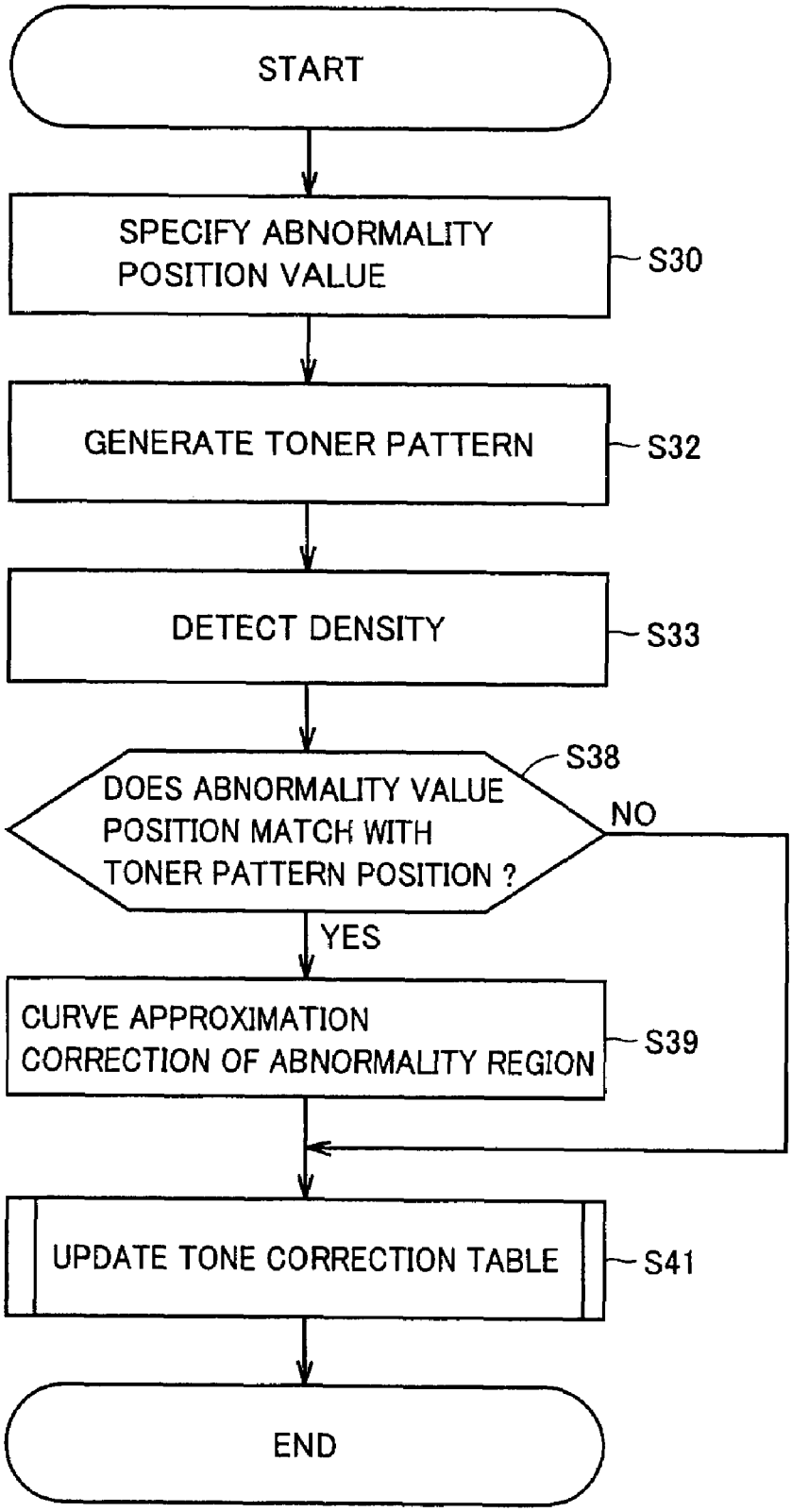
FIG. 14 is a flowchart showing a specific example of processing for updating the tone correction table in image stabilization control in printer 100 according to the second embodiment.

The processing for updating the tone correction table in image stabilization control shown in the flowchart in FIG. 14 is also performed as a result of operation of controller 30 to read and execute the image stabilization control program stored in memory 40 and to control each unit shown in FIG. 13.

Referring to FIG. 14, in printer 100 according to the second embodiment, prior to generation of the toner pattern in step S31, the processing in the following is performed (step S30). Specifically, surface density detection unit 113 detects density based on difference in the color of the surface or in the reflectivity of intermediate transfer belt 9, mark detection unit 115 detects mark 14 on intermediate transfer belt 9, and thereafter, abnormality position specifying unit 117 specifies the abnormality position.

Figure 15:
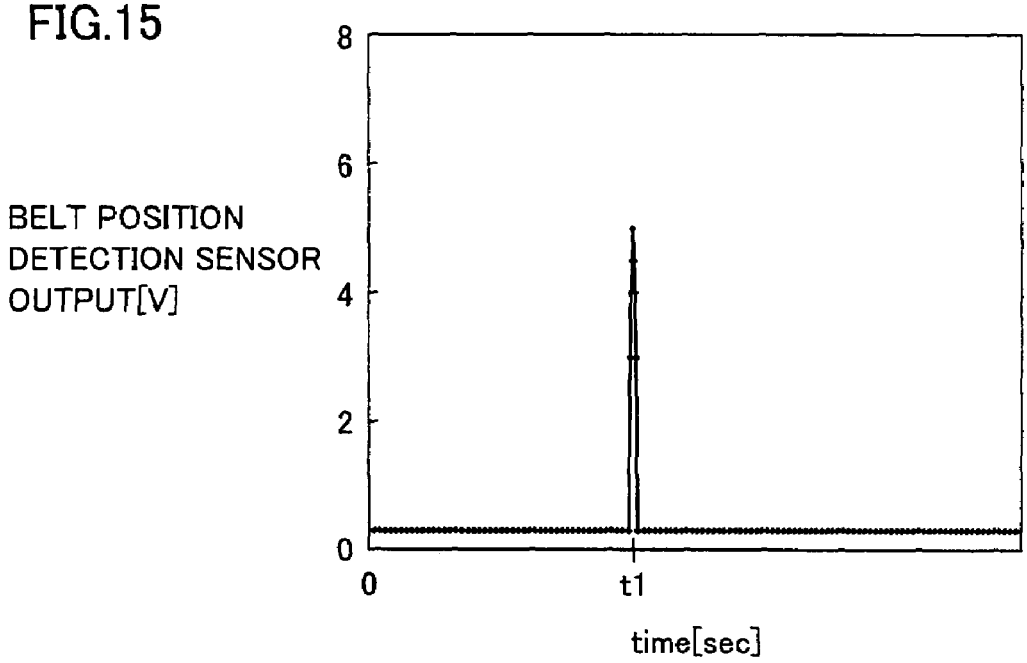
FIG. 15 illustrates a specific example of change over time in a sensor output representing a detection signal value from a density sensor 13A when a mark detection unit 115 detects mark 14.

In FIG. 15, the protruding portion of sensor outputs from density sensor 13A corresponds to the position where mark 14 is detected, that is, the reference position. In addition, in FIG. 16, the portion where sensor outputs from density sensor 13A significantly fluctuate, that is, the portion where density variation is significant, corresponds to the abnormality position. Here, for example, 10% of all outputs (100%) of density sensor 13A is set as the threshold and the portion where an amount of fluctuation in the sensor outputs exceeds the threshold value is detected, thereby detecting the abnormality position.

Figure 16:
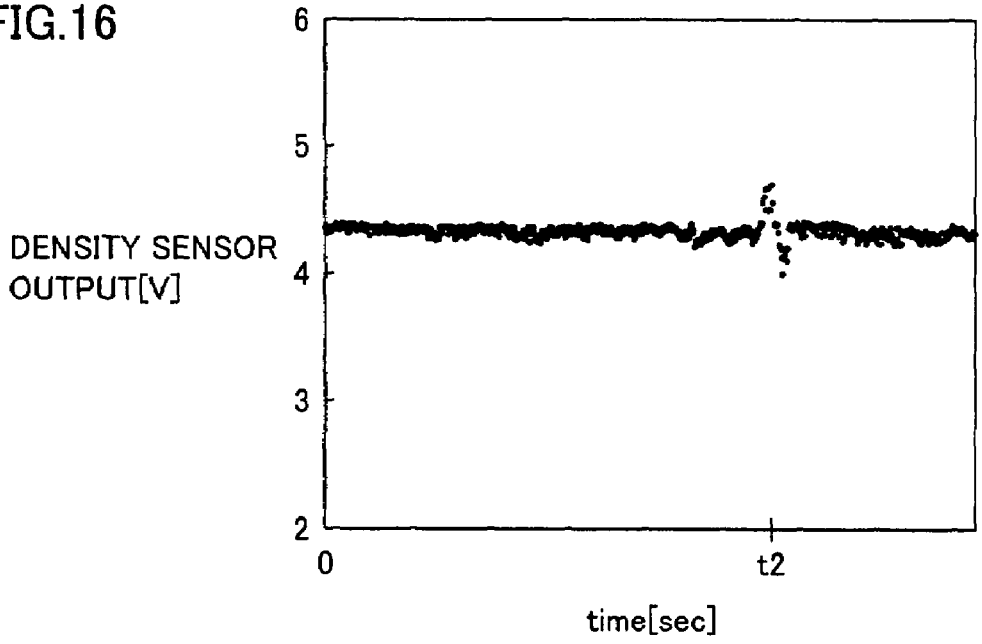
FIG. 16 illustrates a specific example of change over time in a sensor output from density sensor 13A when a surface density detection unit 113 detects density of a color on a surface of intermediate transfer belt 9.

It is assumed that t1 shown in FIG. 15 represents the time when mark 14 is detected, t2 shown in FIG. 16 represents the time when the amount of fluctuation in sensor outputs from density sensor 13A is not smaller than the threshold value, and v represents the moving speed of intermediate transfer belt 9 stored in abnormality position specifying unit 117. Then, in step S30 above, abnormality position specifying unit 117 specifies a position distant from the reference position by $(t2-t1)\times v$ as the abnormality position.

After the processing in step S30, in the processing according to the second embodiment, instead of generation of the toner pattern in step S31, toner pattern generation unit 101 generates the toner pattern on intermediate transfer belt 9 and mark detection unit 115 detects the position of mark 14 before and after the toner pattern is generated, thus specifying the reference position (step S32). Generation of the toner pattern by toner pattern generation unit 101 is similar to the processing in step S31 in the first embodiment. The toner pattern generated here is also similar to that described previously with reference to FIGS. 6 and 7. In the present specific example, it is assumed that mark 14 is detected before and after the toner pattern is generated in step S32, however, mark 14 may be detected at the timing at least one of immediately before or immediately after generation of the toner pattern, if the length of the toner pattern in a direction of movement (longitudinal direction) of intermediate transfer belt 9 is determined in advance. Thereafter, in step S33, as in the processing in the first embodiment, toner pattern detection unit 103 detects density of the toner pattern on intermediate transfer belt 9.

When density of the toner pattern is detected, in the processing in the second embodiment, instead of determination in step S37, determination unit 105 determines whether the toner pattern has been generated at the position on intermediate transfer belt 9 where the abnormality such as creep or flaw is present or in a manner overlapped with the range where the abnormality is present (step S38). In step S38, determination unit 105 calculates a distance between the reference position and the generated toner pattern based on the reference position specified in step S32 and the time from detection of mark 14 until generation of the toner pattern and/or the time from generation of the toner pattern until detection of mark 14, and specifies the position indicating the range of the toner pattern (for example, a start position and/or an end position of the toner pattern). Then, whether the toner pattern includes the abnormality position, that is, whether the toner pattern has been generated at the position on intermediate transfer belt 9 where the abnormality such as creep or flaw is present or in a manner overlapped with the range where the abnormality is present, is determined, based on comparison of the position indicating the range of the toner pattern with the abnormality position specified in step S30. In addition, in step S38, preferably, the range where the abnormality is present overlapping with the toner pattern is also determined.

If generation of the toner pattern overlapping with the abnormality region is determined in step S38 (YES in step S38), in step S39, as in the processing in the first embodiment, curve approximation unit 107 performs curve approximation of the detection values in a range based on the range on intermediate transfer belt 9 where the abnormality is present, that overlaps with the toner pattern. Here, the detection values in a range greater than the range determined as overlapping with the toner pattern in step S38 are preferably subjected to curve approximation. The specific method of curve approximation is not limited to a particular method here either, and for example, a method similar to that described in the first embodiment may be employed. In step S41, as in the processing in the first embodiment, tone correction table updating unit 109 updates the tone correction table stored in tone correction table storage unit 111, based on the curve showing the relation between the input tone and the detection value obtained in step S33 or the curve showing the relation between the input tone and the detection value corrected in step S39.

As a result of execution of such processing for updating the tone correction table in stabilization control in printer 100 according to the present embodiment, even if the detection value obtained by density sensor 13 contains noise due to abnormality of intermediate transfer belt 9 such as creep, the detection value can be corrected and the tone correction table can appropriately be updated. Consequently, the quality of the image formed in printer 100 can be improved.

In addition, as positional relation between the reference position on intermediate transfer belt 9 and the abnormality position on intermediate transfer belt 9 is specified in advance, the detection value containing noise out of the detection values obtained by density sensor 13 can be specified with a simple operation. Therefore, as compared with the example where the detection value containing noise out of the detection values obtained by density sensor 13 is specified using an operation as in the first embodiment, the configuration of the image stabilization control program can be simplified.

Third Embodiment

In the first and second embodiments, the detection values in a wider range, namely, a range expanded toward lower and higher sides of the input tone, than the range determined by determination unit 105 as corresponding to the range on intermediate transfer belt 9 where the abnormality is present, are subjected to curve approximation by curve approximation unit 107. Therefore, the detection value without containing noise, which is the detection value located at the end portion of the range subjected to curve approximation, is used as the boundary condition for curve approximation.

Meanwhile, if determination unit 105 determines that noise is contained in the detection value at the end portion of the detection values, namely, at the end portion of a highlight portion where the input tone attains to the minimum value (0 in the present example) and the detection value attains to the largest value (an amount of reflected light is great) or at the end portion of a shadow portion where the input tone attains to the maximum value (255 in the present example) and the detection value attains to the smallest value (an amount of reflected light is small), as the detection value containing noise is located at the end portion, this detection value cannot be set as the boundary condition.

Figure 17:
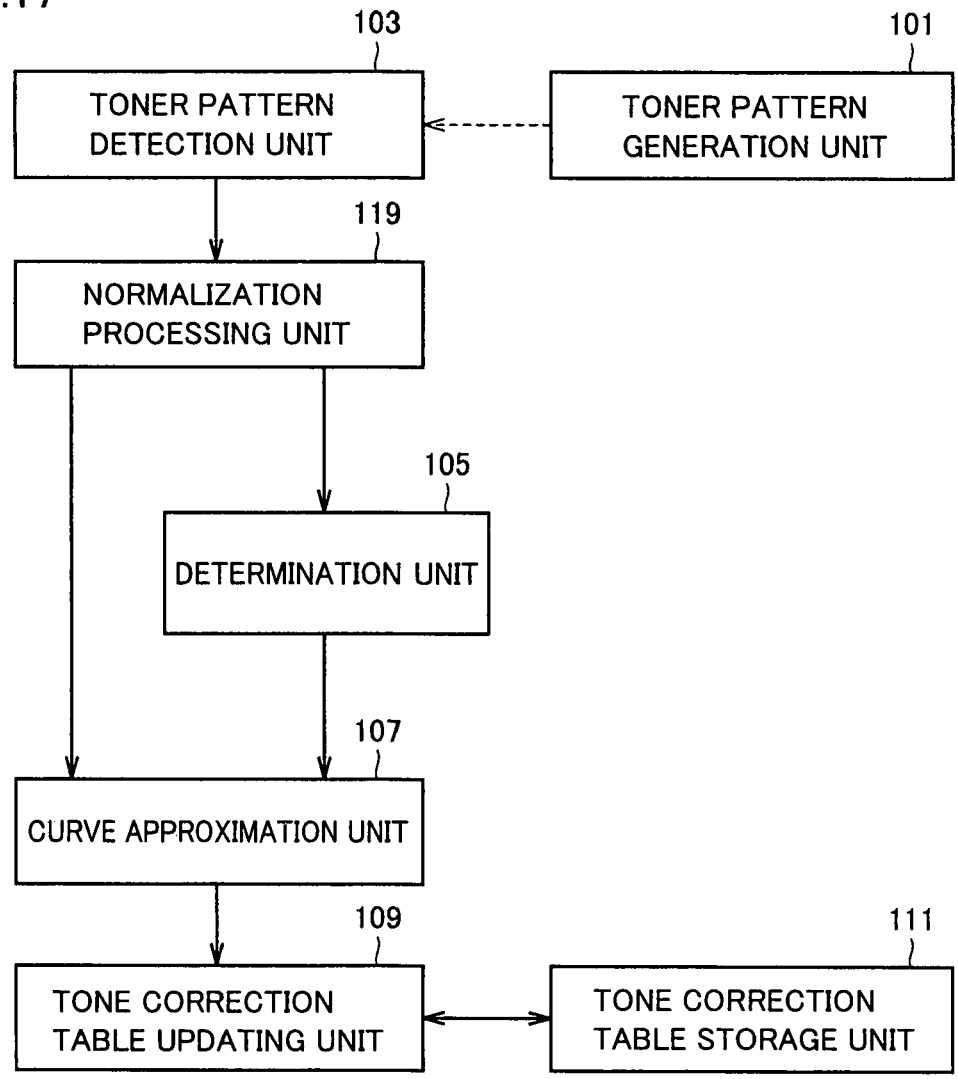
FIG. 17 is a block diagram showing a specific example of a functional configuration for performing processing for updating the tone correction table in image stabilization control in printer 100 according to a third embodiment.

In printer 100 according to the third embodiment, the functional configuration for performing the processing for updating the tone correction table in image stabilization control includes, in addition to each function shown in FIG. 5, a normalization processing unit 119 as shown in FIG. 17.

Normalization processing unit 119 is a function attained mainly in controller 30, and it performs processing for normalizing the detection values from density sensor 13, that are input from toner pattern detection unit 103, and sets the output value at the end portion of the shadow portion to the minimum value (0 in the present example) and sets the output value at the end portion of the highlight portion to the maximum value (255 in the present example). The normalization processing in normalization processing unit 119 is not limited to a particular method, and for example, normalization processing adopting a method of normalizing 8-bit data may be employed.

Figure 18:
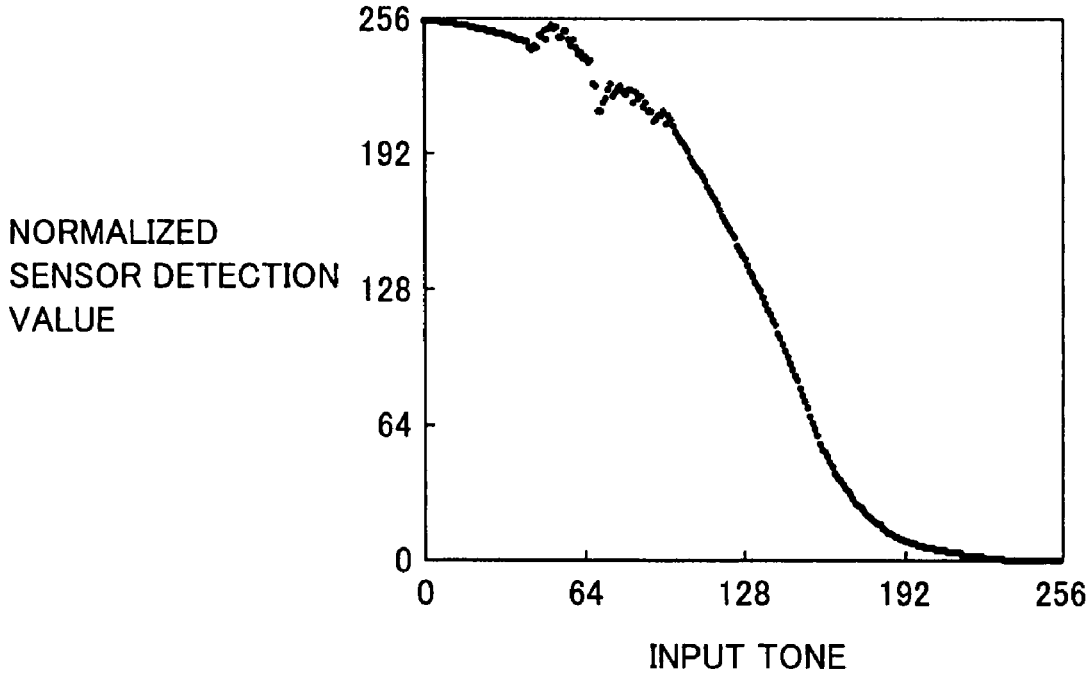
FIG. 18 illustrates a specific example of relation between the input tone of the toner pattern and a normalized detection value.

FIG. 18 shows a specific example of relation between the input tone of the toner pattern and a normalized detection value with respect to the relation between the input tone of the toner pattern and the detection value of density shown in FIG. 9, that is obtained by adopting the 8-bit data normalization method and normalizing the detection value from density sensor 13.

As a result of execution of such normalization processing in the third embodiment, the detection value at the end portion of the shadow portion can be set to 0 and the detection value at the end portion of the highlight portion can be set to 255.

The specific example above shows normalization as to the relation between the input tone and the detection value of density when density sensor 13 detects density by receiving regular reflection of light. If density sensor 13 detects density by receiving diffuse reflection, however, relation between the input tone and the detection value of density is reverse to the relation shown in FIG. 9. Specifically, as the input tone is smaller, the detection value of density is smaller, and as the input tone is greater, the detection value of density is greater. In such a case as well, it goes without saying that normalization the same as in the specific example above may be carried out so that the detection value at the end portion of the shadow portion can be set to 255 and the detection value at the end portion of the highlight portion can be set to 0.

Therefore, even if determination unit 105 determines that noise is contained in the detection value at the end portion of the detection values, curve approximation unit 107 can carry out approximation without setting the detection value containing noise as the boundary condition. Consequently, higher accuracy in approximation is achieved, the tone correction table is appropriately generated, and the quality of the formed image is improved.

Though FIG. 17 shows the configuration including normalization processing unit 119 in addition to each function shown in FIG. 5 as the functional configuration of printer 100 in the third embodiment, normalization processing unit 119 may be included in addition to each function shown in FIG. 13.

In addition, if creep is the factor of noise in printer 100 according to each embodiment above, curve approximation unit 107 may subject the detection values in a range set in advance that corresponds to a range from halftone to the highlight portion to curve approximation, without performing the determination processing by determination unit 105. Here, such a characteristic that noise due to creep is generally likely to be contained in detection values in a range corresponding to a range from halftone to the highlight portion is utilized, and by doing so, higher-speed image forming processing can be achieved.

In addition, the image stabilization control program described above may also be provided. Such a program can be recorded on a computer-readable recording medium such as a flexible disk, a CD-ROM (Compact Disk-Read Only Memory), an ROM (Read Only Memory), an RAM (Random Access Memory), and a memory card adapted to a computer, and can be provided as a program product. Alternatively, the program may be recorded and provided in a recording medium such as a hard disk contained in the computer. Further, the program may be provided by downloading through the network.

Moreover, in the embodiment above, the image stabilization control program is stored in memory 40 of printer 100 serving as the image forming apparatus, and image stabilization control in printer 100 is carried out as a result of operation by controller 30 to read and execute the program. Here, entire image stabilization control or the processing for updating the tone correction table in image stabilization control may be performed in an apparatus different from printer 100, such as a computer. In such a case, the apparatus performing this processing should communicate with printer 100, obtain necessary data, and output the result of processing to printer 100. The provided program described above may encompass such an image stabilization control program stored and executed in another apparatus.

The program according to the present invention may execute the processing by calling a necessary module out of program modules provided as a part of an operation system (OS) of the computer, in a prescribed sequence and at prescribed timing. In such a case, the program itself does not include the module above but executes the processing in cooperation with the OS. Such a program not including the module may be encompassed in the program according to the present invention.

Alternatively, the program according to the present invention may be provided in a manner incorporated as a part of another program. In such a case as well, the program itself does not include the module included in another program, but the program executes the processing in cooperation with another program. Such a program incorporated in another program may be encompassed in the program according to the present invention.

The provided program product is installed in a program storage unit such as a hard disk for execution. It is noted that the program product includes the program itself and the recording medium recording the program.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

a detection unit detecting density of a toner pattern formed on an image carrier;

a determination unit determining a detection value containing noise attributed to abnormality of a shape on said image carrier, out of results of detection by said detection unit;

a correction unit correcting said detection value containing noise by correcting, using curve approximation, tone corresponding to said detection value containing noise out of said results of detection; and a tone correction unit creating tone correction data based on said results of detection corrected by said correction unit and correcting the tone of an input image.

2. The image forming apparatus according to claim 1, wherein a range of said tone to be subjected to said curve approximation by said correction unit includes tone adjacent to said tone corresponding to said detection value containing noise.

3. The image forming apparatus according to claim 1, wherein said determination unit performs processing for calculating a differential value of said detection value as a function of said tone based on the detection value included in said results of detection, and processing for comparing said differential value with a threshold value, and said determination unit determines said detection value, of which differential value exceeds said threshold value, as said detection value containing noise.

4. The image forming apparatus according to claim 1, further comprising:

a first specifying unit specifying a position where abnormality of the shape on said image carrier is present; and a second specifying unit specifying a position of said toner pattern on said image carrier; wherein said determination unit determines said detection value containing noise by determining whether the position of said toner pattern includes the position where abnormality of the shape on said image carrier is present.

5. The image forming apparatus according to claim 1, wherein said correction unit employs, as a boundary condition for said curve approximation, the detection value corresponding to tone at opposing ends of a range of said detection value to be subjected to said curve approximation out of said results of detection.

6. The image forming apparatus according to claim 1, further comprising a normalization unit for normalization such that any one of a detection value corresponding to a maximum value of tone in generating said toner pattern and a detection value corresponding to a minimum value of said tone in generating said toner pattern, out of said results of detection, is set to a maximum value obtained as a result of normalization and another one of them is set to a minimum value obtained as a result of normalization; wherein if at least one of opposing ends of a range of said tone to be subjected to said curve approximation by said correction unit has the maximum value or the minimum value of the tone in generating said toner pattern, said correction unit employs said normalized detection value corresponding to said maximum or minimum value as a boundary condition for said curve approximation.

7. The image forming apparatus according to claim 1, wherein a curve used for said curve approximation is expressed in a polynomial of second or higher order.

8. The image forming apparatus according to claim 1, wherein said image carrier is a belt suspended by a roller, and said abnormality of the shape on said image carrier is creep caused at a position where said image carrier is suspended by said roller as a result that said image carrier is maintained in a non-operating state while suspended by said roller.

9. The image forming apparatus according to claim 1, wherein said abnormality of the shape on said image carrier is attributed to breakage of said image carrier or deterioration of said image carrier.

10. The image forming apparatus according to claim 1, further comprising:

a surface density detection unit detecting surface density of the image carrier, a mark detection unit detecting a mark corresponding to a reference position on the image carrier, and a specifying unit specifying a position of the abnormality of the shape on the image carrier for a distance from the reference position based on the result of the surface density detection unit and the mark detection unit, wherein the determination unit compares the position specified by the specifying unit and the position of the toner pattern, and determines the detection value containing noise attributed to abnormality in the density detected by the detection unit.

11. A method of image stabilization control in an image forming apparatus including an image carrier, comprising:

detecting density of a toner pattern formed on said image carrier;

determining a detection value containing noise attributed to abnormality of a shape on said image carrier, out of results of detection obtained in said detecting step;

correcting said detection value containing noise by correcting, using curve approximation, tone corresponding to said detection value containing noise out of said results of detection; and creating tone correction data based on said results of detection corrected in said correcting step and correcting the tone of an input image.

12. A computer readable medium storing a program, said program causing a computer to carry out image stabilization control in an image forming apparatus including an image carrier, comprising:

detecting density of a toner pattern formed on said image carrier;

determining a detection value containing noise attributed to abnormality of a shape on said image carrier, out of results of detection obtained in said detecting step;

correcting said detection value containing noise by correcting, using curve approximation, tone corresponding to said detection value containing noise out of said results of detection; and creating tone correction data based on said results of detection corrected in said correcting step and correcting the tone of an input image.

* * * * *